US009586420B2

(12) United States Patent
Sato et al.

(10) Patent No.: US 9,586,420 B2
(45) Date of Patent: Mar. 7, 2017

(54) PRINTER AND METHOD FOR PRINTING

(71) Applicant: SATO HOLDINGS KABUSHIKI KAISHA, Tokyo (JP)

(72) Inventors: Yasushi Sato, Tokyo (JP); Masayuki Iioka, Tokyo (JP); Yoshimasa Kubo, Tokyo (JP); Seiichiro Nagata, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/896,462

(22) PCT Filed: Jul. 29, 2014

(86) PCT No.: PCT/JP2014/069948

§ 371 (c)(1),
(2) Date: Dec. 7, 2015

(87) PCT Pub. No.: WO2015/033702

PCT Pub. Date: Mar. 12, 2015

(65) Prior Publication Data

US 2016/0107459 A1 Apr. 21, 2016

(30) Foreign Application Priority Data

Sep. 4, 2013 (JP) ..... 2013-182823

(51) Int. Cl.
*B41J 15/04* (2006.01)
*B41J 13/00* (2006.01)
(Continued)

(52) U.S. Cl.
CPC ..... *B41J 13/0009* (2013.01); *B41J 2/32* (2013.01); *B41J 3/01* (2013.01); *B41J 3/4075* (2013.01); *B41J 11/36* (2013.01); *B41J 11/425* (2013.01)

(58) Field of Classification Search
CPC ..... B41J 13/00; B41J 13/0009; B41J 15/00; B41J 15/04; B41J 15/044; B41J 15/046
See application file for complete search history.

(56) References Cited

U.S. PATENT DOCUMENTS

2009/0309945 A1 12/2009 Matsuda
2012/0133720 A1 5/2012 Sato

FOREIGN PATENT DOCUMENTS

JP H 05-205084 8/1993
JP 2009-298036 12/2009
(Continued)

*Primary Examiner* — Kristal Feggins
(74) *Attorney, Agent, or Firm* — Ostrolenk Faber LLP

(57) ABSTRACT

A printer using heat to print on a print medium improves a print processing speed over an entire print surface of a print medium. In print processing of a label (PL), the feeding speed at a print region (SW) for printing a barcode or the like is slower than a standard feeding speed, and the feeding speed at a margin region (SY) that has a length that is at least a predetermined length in the feeding direction (F) among the margin regions is faster than the standard feeding speed. Further, the feeding speed at a printing area (NW) for printing character, symbol, or the like, and the feeding speed at a margin region (NY) that has a length smaller than the predetermined length in the feeding direction (F) are set to the standard feeding speed. Accordingly, the print processing speed over the entire print surface of the label (PL) may be improved in the printer using heat to print on a label (PL).

20 Claims, 11 Drawing Sheets

(51) Int. Cl.

| | |
|---|---|
| ***B41J 2/32*** | (2006.01) |
| ***B41J 3/01*** | (2006.01) |
| ***B41J 3/407*** | (2006.01) |
| ***B41J 11/36*** | (2006.01) |
| ***B41J 11/42*** | (2006.01) |

(56) References Cited

FOREIGN PATENT DOCUMENTS

| | | |
|---|---|---|
| JP | 2011-207063 | 10/2011 |
| JP | 2012-113608 | 6/2012 |
| JP | 2012-116083 | 6/2012 |

PRINTER AND METHOD FOR PRINTING

TECHNICAL FIELD

A present disclosure relates to a printer and method for printing. For example, the present disclosure relates to a thermal printer configured to use heat to print predetermined information such as a character, a symbol, a shape, a barcode, or the like, on each of a plurality of labels that are temporarily attached to an elongated mount.

BACKGROUND ART

A thermal printer configured to print on a label or the like by selectively heating a plurality of thermosensitive resistors positioned on a print line of a thermal head.

In printing process of the thermal printer, printing on a label or the like is accomplished by feeding a mount that has plurality of labels temporarily attached thereto via a platen roller such that the mount is sandwiched between the thermal head and the platen roller, and by using an electric current to heat a desired thermosensitive resistor on a print line of the thermal head so as to be pressed onto a label of the mount during the feeding.

For example, a thermal printer such as that described above is disclosed in Patent Literature 1. Patent Literature 1 describes technology that prevents a trailing phenomenon of a serial barcode by calculating a print rate of the serial barcode at every print line, and by setting a print speed of each print line in response to the calculation result.

Patent Literature 2 describes technology that prevents the trailing phenomenon of a serial barcode by detecting a change point from a bar to a space in a case where printing the serial barcode, and then rapidly outputting a drive signal to print the bar just before the space.

Patent Literature 3 describes technology configured to print a section other than a serial barcode at high-speed.

RELATED ART

Patent Literature

Patent Literature 1: JP-A 2009-298036;
Patent Literature 2: JP-A 2012-116083; and
Patent Literature 3: JP-A H05-205084.

SUMMARY OF THE INVENTION

Problems to be Solved by the Invention

In a case of printing a barcode or the like, as well as a character, symbol, or the like, across an entire print surface of a label or the like, a feeding speed for printing the barcode is decreased more than that for printing a character, symbol, or the like, from a perspective of preventing a barcode reading error. Thus, a print processing speed across the entire print surface of the label of the like is reduced.

A present disclosure has been conceived of in view of the above mentioned technical background. The purpose of the present disclosure is proposing technology that may improve a print processing speed across the entire print surface of the print medium.

Means for Solving the Problems

In order to solve a problem, a printer according to claim 1 of a present invention, includes:

a feeder configured to feed a print medium towards an ejection port along a feeding pathway;

a print part configured to use heat to print on the print medium during the feeding of the print medium; and a controller configured to set a feeding speed of a first print region on which coded first print information is printed to a second feeding speed that is slower than a predetermined first feeding speed, and to set a feeding speed of a second print region on which second print information other than the coded first print information is printed to the first feeding speed, the print medium including the first print region and the second print region, the controller in operation setting the feeding speed of the second print region on which the second print information is printed, the second print information being arranged with the first print information in a width direction of the print medium, the second print information including a portion partially extending from the first print region on which the first print information is printed, the first print information being arranged with the second print information in a lengthwise direction of a feeder body, among a plurality of second print information, to the feeding speed of the first print region on which the first print information is printed.

A present invention according to claim 2 is that, in the printer according to claim 1, the controller is configured to set a feeding speed of a first margin region having a length in a feeding direction of the print medium longer than a predetermined length to a third feeding speed that is faster than the first feeding speed, among a plurality of margin regions of the print medium.

A present invention according to claim 3 is that, in the printer according to claim 2, the controller is configured to set the feeding speed of a second margin region that is shorter than the predetermined length to the first feeding speed, among the plurality of the margin regions of the print medium.

A method for printing according to claim 4, in a case where using heat to print on the print medium during feeding the print medium, includes:

feeding the print medium in a first print region thereof on which coded first print information is printed at a second feeding speed that is slower than a predetermined first feeding speed;

feeding the print medium in a second print region thereof on which second print information other than the coded first print information is printed at the first feeding speed; and feeding the print medium in the second print region on which the second print information is printed, the second print information being arranged with the first print information in a width direction of the print medium, the second print information including a portion partially extending from the first print region on which the first print information is printed, the first print information being arranged with the second print information in a lengthwise direction of a feeder body, among a plurality of second print information, at the feeding speed of the first print region on which the first print information is printed.

A present invention according to claim 5 is that, in the method according to claim 4, it includes feeding the print medium in a first margin region having a length in the feeding direction of the print medium that is longer than a predetermined length is at a third feeding speed that is slower than the first feeding speed, among the plurality of margin regions of the print medium.

A present invention according to claim 6 is that, in the method according to claim 5, it includes feeding the print medium in a second margin region that is shorter than the predetermined length and the second print region that prints the second print information other than the coded first print information is at the first feeding speed, among the plurality of margin regions of the print medium.

Effects of the Invention

According to the present invention of claim 1, a printer using heat to print on a print medium may ensure a print quality of a second print information that has a partially protruding portion.

According to the present invention of claim 2, control may be simplified and print processing speed may be improved across an entire surface of a print medium.

According to the present invention of claim 3, the control may be simplified and the print processing speed may be further improved across the entire surface of the print medium.

According to the present invention of claim 4, the printer using heat to print on the print medium may ensure the print quality of the second print information that has a partially protruding portion.

According to the present invention of claim 5, the print processing speed may be further improved across the entire surface of the print medium, without complicated controls.

According to the present invention of claim 6, the print processing speed may be improved across the entire surface of the print medium.

DETAILED DESCRIPTION OF THE INVENTION

Figure 1:
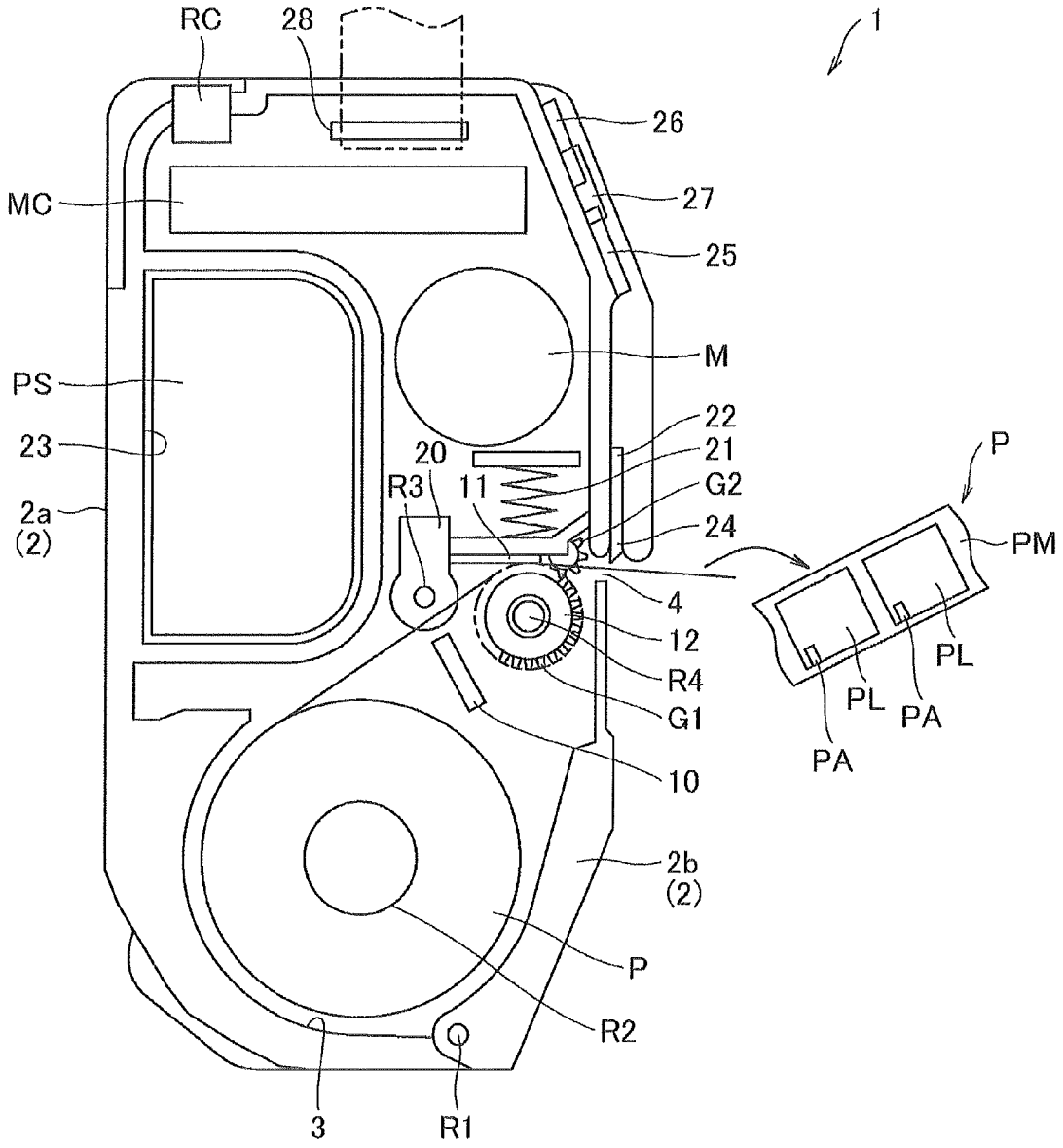
FIG. 1 shows a cross-sectional view of a printer according to a first embodiment of a present disclosure.

Hereinafter, embodiments will be described with reference to the drawings as an example of the present disclosure. In the drawings used to describe the embodiments of the present disclosure, the same reference numerals are used to designate the same or similar components, and thus redundant descriptions thereof are omitted.

First Embodiment

FIG. 1 shows a cross-sectional view of a printer according to an embodiment of a present disclosure.

A printer 1 of an embodiment of the present disclosure is, e.g., a portable thermal printer for label printing by using heat to print a character, a symbol, a shape, a barcode, a two-dimensional code, or the like, onto a label PL that is temporarily attached to a mount PM of a continuous paper (print medium) P.

A casing 2 that constitutes the printer 1 includes a housing 2*a*, and an opening and closing cover 2*b* that is partially axially fixed thereto.

The housing 2*a* is formed into a rectangular shape or the like. An opening is formed in part of the housing 2*a*. The opening and closing cover 2*b* is disposed at the opening of the housing 2*a*, such that the opening of the housing 2*a* is configured to open and close. The opening and closing cover 2*b* is configured to freely rotate around a rotatable shaft R1.

Moreover, an opening of the housing 2*a* is configured to communicate with a continuous paper container 3 that is formed inside the casing 2. In a case where the opening and closing cover 2*b* is open, the continuous paper P that is wound-up into a rolled shape may be stored in the continuous paper container 3 inside the casing 2 from the opening of the housing 2*a*. In addition, in a case where the opening and closing cover 2*b* is closed, an ejection port (discharge port) 4 configured to eject the continuous paper P is formed between an end of the opening and closing cover 2*b* and the opposing housing 2*a* that opposes to the end.

A roll-shaped continuous paper P is rotatably stored in the continuous paper container 3 inside the casing 2, in a wound-up configuration in a winding core R2. The mount PM that constitutes the continuous paper P is formed into an elongated shape. A plurality of labels PL are temporarily attached at each predetermined interval along a lengthwise direction on a front surface of the mount PM.

A release agent such as silicone is applied to a front surface of the mount PM in contact with an adhesive surface of the label PL. Thus, the label PL may be easily removed. In addition, a position detection mark PA is formed that indicates a position of the label PL at each predetermined interval along the lengthwise direction on a rear surface of the mount PM.

The label PL is a so-called thermal label. A thermosensitive color developing layer is formed that develops into a specific color (such as black or red) after reaching a predetermined temperature region.

The continuous paper P inside the continuous paper container 3 at a time of print processing is fed towards the ejection port 4. The fed continuous paper P is drawn out into a sheet shape. After the print processing onto the label PL during the feeding of the continuous paper P, the continuous paper P that includes the label PL is ejected from the ejection port 4 outside the printer 1.

In the casing 2 of the printer 1, a position detection sensor 10, a thermal head 11 (print part) and platen roller 12 (feeder) are disposed along a paper feeding route and on an opposite side of the continuous paper container 3, as well as a motor M, a controller MC, a rechargeable battery PS and a wireless communicator RC are disposed.

The position detection sensor 10 is configured to detect a position of the label PL of the continuous paper P by detecting the position detection mark PA on a rear surface of the continuous paper P.

The position detection sensor 10 is disposed on a rear surface side of the opening and closing cover 2*b*. A sensor surface of the position detection sensor 10 is attached so as to face a rear surface of the continuous paper P (feeding route side) in a case where the opening and closing cover 2*b* is closed.

For example, the position detection sensor 10 includes a light reflection sensor. In other words, the position detection sensor 10 includes a light emitter and a light receiver on the sensor surface. The position detection sensor 10 is configured to detect a position of the label PL by detecting of light emitted from the light emitter in the direction of the position detection mark PA of the continuous paper P, and using the light receiver configured to receive light reflected from the continuous paper P. An LED (light emitting diode) or the like may be employed in the light emitter. A photodiode, phototransistor, or the like, may be employed in the light emitter.

The position detection sensor 10 is electrically connected to the controller MC. The position detection sensor 10 is configured to send a detection signal to the controller MC. The controller MC is configured to calculate a relative positional relationship between the label PL of the continuous paper P and the printer (print line) of the thermal head 11 based on the detection signal from the position detection sensor 10, and to control a rotational operation (such as a rotational direction or a rotational angle) of a platen roller 12 based on a calculation result in order to apply print at a defined position of the label PL.

The thermal head 11 is a print part configured to apply print to the label PL via the thermal resistor of the print line arranged on the print surface thereof.

A plurality of thermal resistors (heating elements) that generate heat by electric conduction are arranged in parallel along a width direction (direction orthogonal to a feeding direction of the continuous paper P) of the continuous paper P on the print line of the thermal head 11.

For example, a dimension in a long direction of the print line (dimension in the width direction of the continuous paper P) is approximately 50 mm, and a dimension in a short direction (dimension in the feeding direction of the continuous paper P) of the print line is approximately 0.125 mm. For example, eight thermal resistors are arranged in 1 mm so that 400 thermal resistors in total are arranged in the print line.

The thermal head 11 is fixed to a support member 20 such that a print surface of the thermal head 11 faces a feeding route. A head-biasing spring 21 is disposed on a rear surface of the support member 20. A print surface of the thermal head 11 is configured to be pressed against the platen roller 12, in a case where the opening and closing cover 2*b* is closed.

The support member 20 is axially fixed to an inside of the housing 2*a* so as to freely rotate around a rotary shaft R3 on a first end thereof. A second end of the support member 20 is engaged with the press-button 22 used for opening the opening and closing cover 2*b* described hereinafter.

The thermal head 11 is electrically connected to the controller MC. The controller MC is configured to apply print on the label PL by selectively sending an electric current to the plurality of thermal resistors of the thermal head 11 in order to cause a desired thermal resistor to generate heat in response to a print data or the like inputted into the printer 1.

The platen roller 12 is a feeder configured to feed the continuous paper P inside the continuous paper container 3 towards the ejection port 4 via the feeding route. The platen roller 12 is attached so as to freely rotate in a forward and reverse direction around a rotary shaft R4 on a rear surface side of the opening and closing cover 2*b*. The platen roller 12 is arranged in an opposing configuration so as to be pressed against a print surface of the thermal head 11, in a case where the opening and closing cover 2*b* is closed.

An elastic material such as a hard rubber is coated onto a surface of the rotary shaft R4 of the platen roller 12. Moreover, a gear G1 is connected to a first end in a shaft direction of the rotary shaft R4 of the platen roller 12. The gear G1 engages with the rotary shaft of the motor M via a connection gear G2 in the housing 2*a*. In a case where the opening and closing cover 2*b* is closed, a rotational driving force of the motor M is capable of being transmitted to the platen roller 12 by engaging the gear G1 on a side of the platen roller 12 with the rotary shaft of the motor M via the connection gear G2.

For example, the motor M is a stepping motor. The motor M is electrically connected to the controller MC. The controller MC is configured to control the rotary operation (such as a rotational direction or a rotational angle) of the motor M in response to the print data or the like inputted into the printer 1.

The rechargeable battery PS is a power source configured to supply electric power to an entire electrical system of the printer 1, which includes the thermal head 11 and the motor M. The rechargeable battery PS is stored in a freely attachable and detachable configuration inside a battery container 23 of the casing 2.

The wireless communicator RC is a non-contact inputter configured to receive print data (such as a command or print information) sent to the printer 1 from outside of printer 1 by wireless communication such as infrared or radio waves. The wireless communicator RC is electrically connected to the motor M.

On the other hand, the press-button 22 used for opening, a cutter 24, an inputter 25, a display 26, a power switch 27, and a belt-hanging part 28 are disposed on a surface of the housing 2*a* of the printer 1.

The press-button 22 used for opening is a button used for opening the opening and closing cover 2*b*. In a case where pressing the press-button 22 on an enclosed side of the housing 2*a*, a second end of the support member 20 is pressed, the support member 20 rotates in a counter-clockwise direction around the rotary shaft R3 against a biasing force of a spring 21. Accordingly, the thermal head 11 is separated from the platen roller 12 and the opening and closing cover 2*b* is opened by disengaging a locking member (not shown), which is engaged with the support member 20, from lockpins (not shown) of the platen roller 12. In a case where pressing the opening and closing cover 2*b* on an enclosed side of the housing 2*a* against the biasing force of the spring 21, the opening and closing cover 2*b* is closed. The locking member engaged with the support member 20 sandwiches the lockpins of the platen roller 12 so that the closed configuration of the opening and closing cover 2*b* is maintained.

The cutter 24 is a member configured to cut the continuous paper P after printing. The cutter 24 is disposed on an outer wall surface of the housing 2*a* so as to extend along a width direction (direction orthogonal to a feeding direction of the continuous paper P) of the continuous paper P, and so as to have a sharp edge of an end thereof slightly protrude on a side of the ejection port 4.

The cutter 24 is composed of synthetic resin or the like having a predetermined rigidity and elasticity. The cutter 24 is integrally formed with the press-button 22. In a cutting process of the continuous paper P by the cutter 24, a part of the mount PM, which is located between adjacent labels PL of the continuous paper P ejected from the ejection port 4 after print processing, is cut.

The inputter 25 is a part which an operator uses for inputting the print data (such as a command or print information) into the printer 1. A plurality of operation keys are disposed for input of data, for indication of direction, or for execution (including print ejection).

The display 26 is a part configured to display various messages or the like, in addition to displaying a process mode or information inputted by the inputter 25 or the like. The display 26 is disposed in the vicinity of the inputter 25. The display 26 includes an LCD (liquid crystal display).

A belt-hanging part 28 is a part which the operator uses for equipping the printer 1 to a shoulder or waist of the operator, via insertion of a belt. The belt-hanging part 28 is integrally formed with the housing 2*a*.

Figure 2:
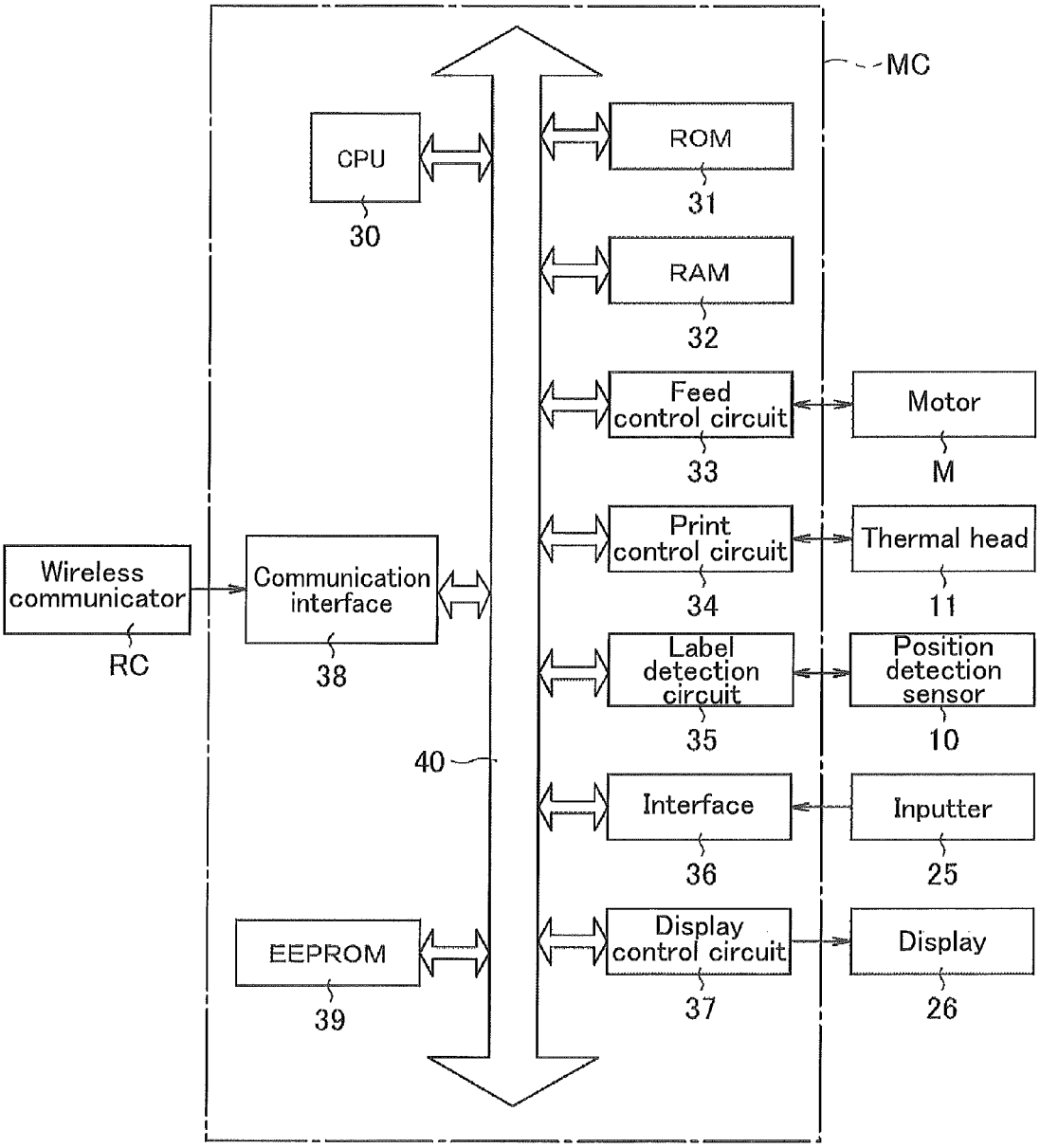
FIG. 2 shows a main part circuit block diagram of the printer of FIG. 1.

Next, FIG. 2 shows a main part circuit block diagram of a printer of FIG. 1.

The controller MC is a part configured to control operation of the entire printer 1. The controller MC includes: a CPU (central processing unite) 30; a ROM (read-only memory) 31; a RAM (random access memory) 32; a feed control circuit 33; a print control circuit 34; a label detection circuit 35; an interface 36; a display control circuit 37; a communication interface 38; an EEPROM (electrically erasable programmable ROM) 39; and a bus line 40, which is configured to electrically connect the CPU 30, the ROM 31, the RAM 32, the feed control circuit 33, the print control circuit 34, the label detection circuit 35, the interface 36, the display control circuit 37, the communication interface 38, and the EEPROM 39 with each other.

The CPU 30 is electrically connected to the inputter 25 and the display 26 via the interface 36 and the display control circuit 37. The CPU 30 is configured to communicate wirelessly with an external portable device via the communication interface 38.

A software (control program) for controlling the operation of the printer 1 is stored in the ROM 31. The RAM 32 is configured to record each type of data necessary to operate the CPU 30, and to temporarily store the print data received from the inputter 25 or the external portable device. In addition, the CPU 30 is configured to control an operation of each part of the feed control circuit 33, the print control circuit 34, or the like, in accordance with the control program.

The feed control circuit 33 is configured to send a pulse signal to the motor M, and to control a feeding operation of the continuous paper P by the platen roller 12. The print control circuit 34 is configured to produce a control signal corresponding to the print data sent from the CPU 30, to send the produced control signal to the thermal head 11, and to control the printing operation.

The label detection circuit 35 is configured to control the light emitter of the position detection sensor 10 under the control of the CPU 30. The label detection circuit 35 is configured to emit light towards the continuous paper P, to receive an outputted electric signal from the light receiver of the position detection sensor 10, to convert the signal to digital data, and to send the digital data to the CPU 30. The EEPROM 39 is configured to record each type of configuration data or the like in the printer 1.

Each part is electrically connected to the CPU 30 via the bus line 40. Each part is configured to apply print on the label PL of the continuous paper P via the thermal head 11 in accordance with the print data received from the communication interface 38 or the interface 36 under an administration of the CPU 30.

Figure 3:
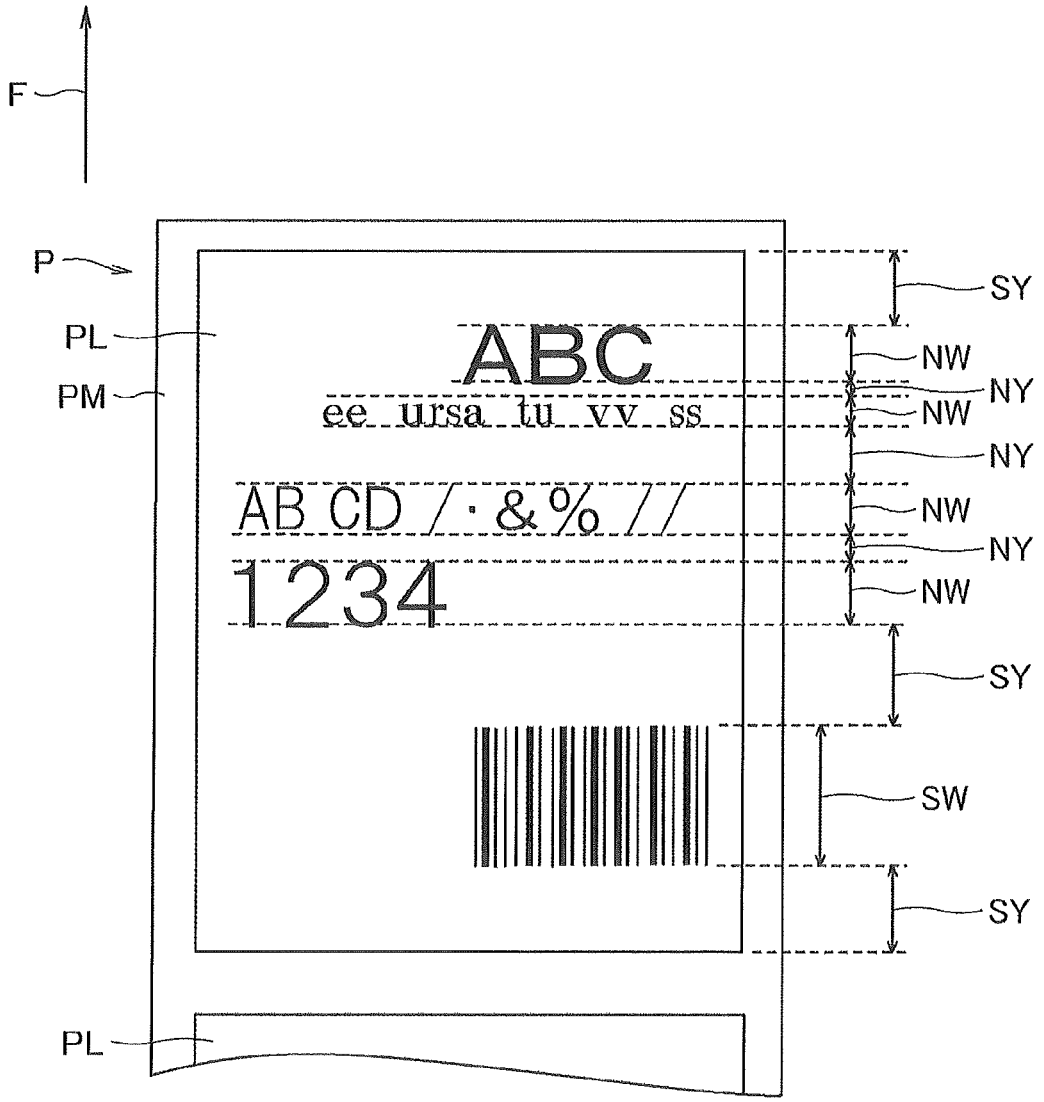
FIG. 3 shows a main part planar view of a continuous paper indicating an example of print information printed onto a single label.

Next, FIG. 3 shows a main part planar view of a continuous paper indicating an example of the print information printed onto a single label. An arrow F in FIG. 3 indicates a feeding direction of the continuous paper P.

Two print regions SW and NW, and two margin regions SY and NY, are arranged along a feeding direction F of the continuous paper P on the label PL.

The print region SW (first print region) indicates a region on which coded first print information such as a barcode or a two-dimensional code printed is printed. The coded print information is print information that is digitally processed such that the content or the like thereof cannot be visually verified by a human being alone. Accordingly, the barcode on the print region SW is exemplified. Moreover, a black bar of the barcode that extends along the feeding direction F of the continuous paper P, i.e., parallel barcode, is exemplified.

The print region NW (second print region) indicates a region on which standard print information such as a character, a symbol, a shape or a picture is printed. The standard print information is second print information other than the coded print information. The standard print information is information that the content or the like thereof can be visually verified by a human being alone.

On the other hand, the margin region SY (first margin region) is a non-standard margin region in which a length in the feeding direction F is determined to be at least a predetermined length. This predetermined length is, e.g., 3 mm. However, the length is not limited thereto. The reason for the length will be explained hereinafter.

The margin region NY (second margin region) is a standard margin region in which a length in the feeding direction F is determined to be shorter than the predetermined length.

Next, an example of a printing method of the printer 1 will be explained with reference to FIGS. 1, 2, and 6 to 8, in view of a flow chart of FIG. 4.

First, the print data on the print surface of a single label PL is wirelessly received via the wireless communicator RC or the like (step 100 of FIG. 4), as indicated in FIGS. 1 and 2.

For example, the print data includes the command as well as the standard print information, the coded print information, and the margin information. For example, the standard information includes a font type (such as Gothic typeface or Ming-cho typeface), a font size, or a print starting position. For example, the coded print information includes the print starting position, a print finishing position, a length in a feeding direction, or a length in a width direction orthogonal to the feeding direction. For example, the margin information includes the length in a feeding direction.

Figure 4:
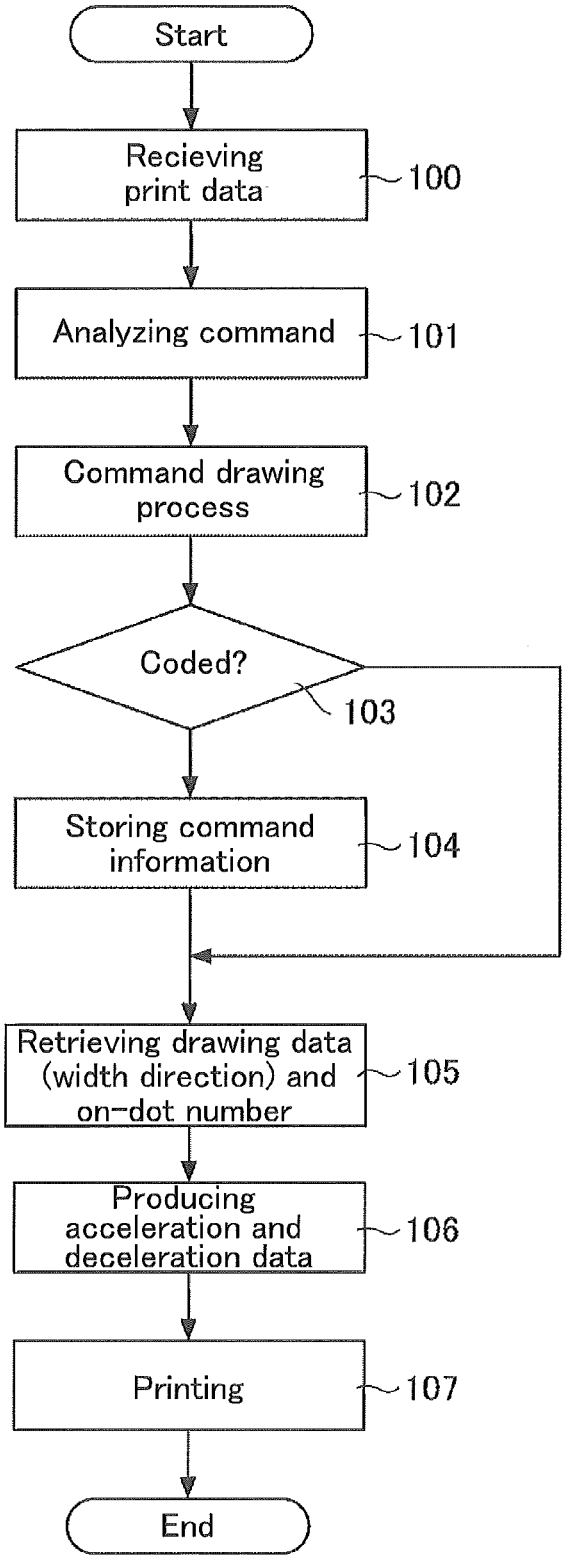
FIG. 4 shows a block diagram indicating an example of a printing method of the printer of FIG. 1.

Next, the received print data is developed in an image buffer (RAM 32 of FIG. 2), and then each print line (e.g., 0.125 mm) of the thermal head 11 is analyzed for a presence or absence of print (step 101 of FIG. 4).

Figure 5:
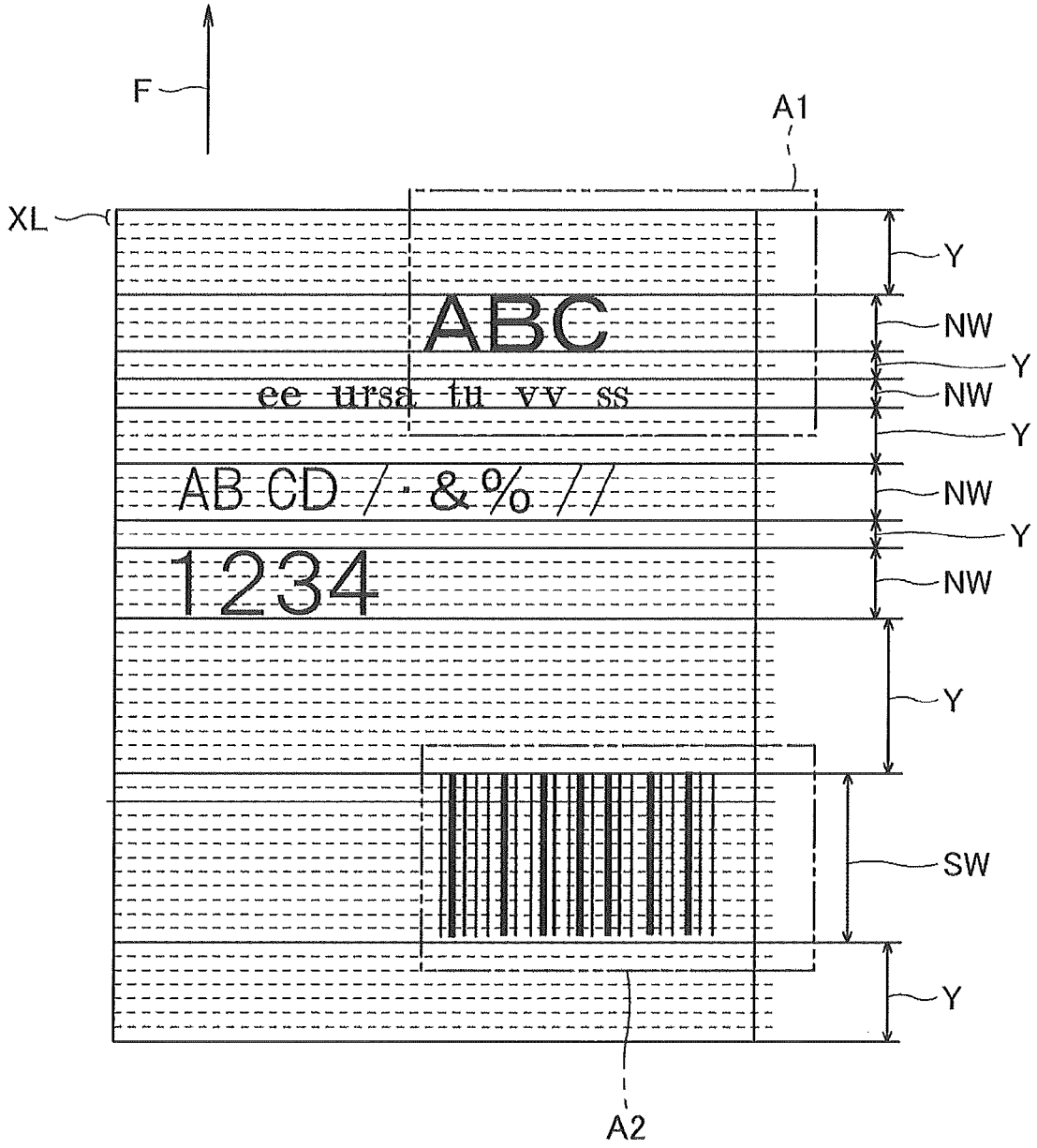
FIG. 5 shows a planar view of an example illustrating the imaging of the single label and the print data developed in memory.
Figure 6A:
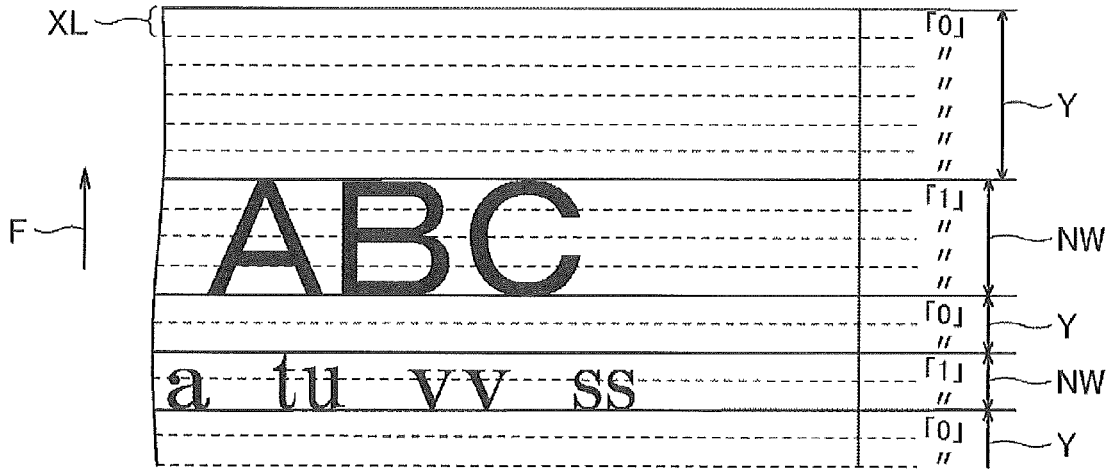
FIG. 6A shows an enlarged planar view of region A1 of FIG. 5.
Figure 6B:
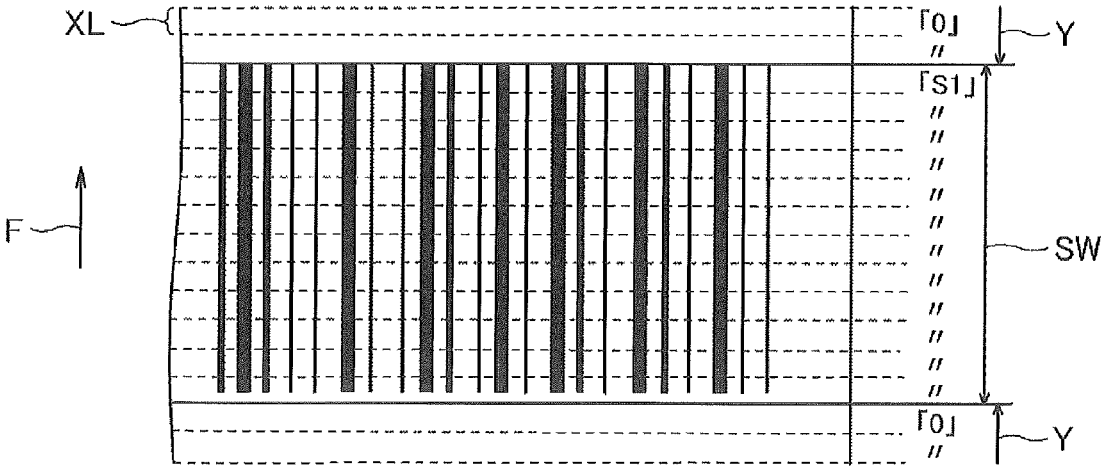
FIG. 6B shows an enlarged planar view of region A2 of FIG. 5.

FIGS. 5 and 6 show schematic views of an example illustrating the imaging of the single label PL and the print data developed in RAM 32. FIG. 6A shows an enlarged planar view of region A1 of FIG. 5; and FIG. 6B shows an enlarged planar view of region A2 of FIG. 5.

"1" or "S1" represents a case where print is present on each print line XL along the feeding direction F of the label PL, and "0" represents a case where print is not present on each print line XL along the feeding direction F of the label PL (see, FIG. 6). Accordingly, the print region NW on which the standard print information is printed is recognized as a region represented by "1," and the print region SW on which the coded print information is printed is recognized as a region represented by "S1". Moreover, a margin region Y is recognized as a region represented by "0".

Next, a position coordinate of each print information (standard print information and coded print information) is determined. In other words, a printing position of each print information (such as a print starting position and a print finishing position) is determined. Accordingly, drawing data is produced (step 102 of FIG. 4).

Then, a determination is made as to whether or not the print information in each region in the feeding direction F of the drawing data is the coded print information (step 103 of FIG. 4). In a case where it is determined that the print information is coded print information, information such as the print finishing position or the print starting position (i.e., the length in the feeding direction F of the coded print information (top and bottom)) of the coded print information is stored (step 104 of FIG. 4).

Next, an on-dot number in a width direction (direction orthogonal to the feeding direction F) is retrieved for the drawing data (step 105 of FIG. 5).

Then, a feeding speed data is produced for each region (print regions SW and NW, and margin region Y) in the feeding direction F of the drawing data (step 106 of FIG. 4). The production of the feeding speed data will be explained hereinafter.

Hereinafter, print processing using the feeding speed data and the drawing data produced in the abovementioned manner (step 107 of FIG. 4) is performed.

In the print processing of the printer 1, the continuous paper P is fed by rotating the platen roller 12 via the motor M such that the continuous paper P is sandwiched between the thermal head 11 and the platen roller 12, as shown in FIG. 1. In the feeding of the continuous paper P, the continuous paper P is fed at a feeding speed set in the feeding speed data in each region of the label PL. In addition, a print timing is determined based on a detection signal from the position detection sensor 10 during feeding, heating of the desired thermal resistor of the thermal head 11 is caused by sending a printing signal to the thermal head 11 in order to print the print information on the label PL on the continuous paper P. In a case of print in the print regions NW and SW, printing is performed by repeatedly feeding and stopping at each print line.

An end in the feeding direction of the label PL may be used as timing to start print, based on the detection signal from the position detection sensor 10.

Next, an example of a production method of feeding speed data of each region in the feeding direction F of the label PL will be explained in accordance with a flow chart of FIG. 7.

Figure 7:
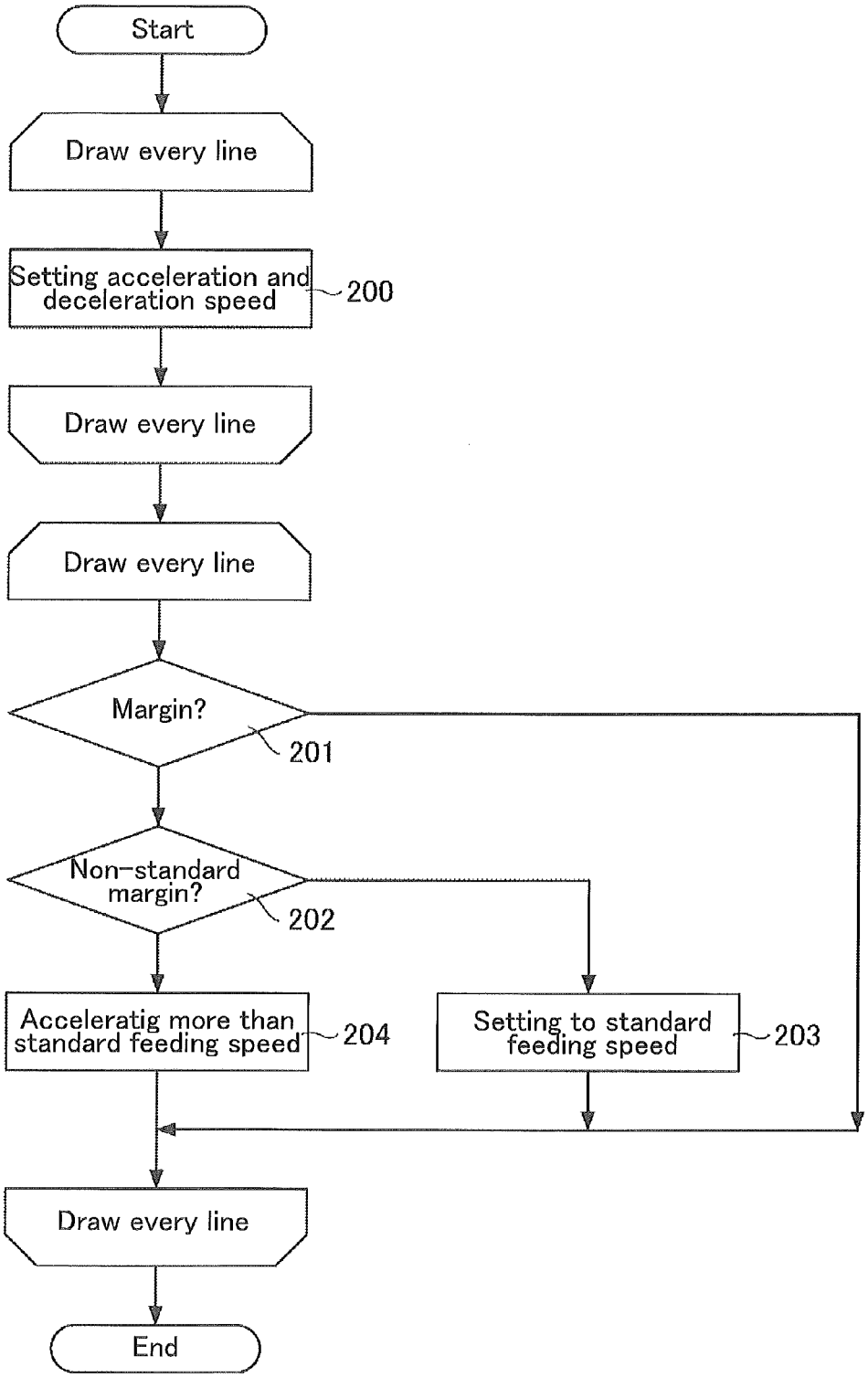
FIG. 7 shows a flow chart diagram indicating a production example of feeding speed data of a print flow of FIG. 4.

First, the feeding speed of the print regions NW and SW is set in every line in the feeding direction F in the drawing data (step 200 of FIG. 7).

The feeding speed of the print region NW on which the standard print information is printed is set to the standard feeding speed (first feeding speed). The feeding speed (standard feeding speed) of the print region NW is, e.g., 80 mm/sec.

The print region SW in which the coded print information (exemplified by barcode) is printed is set to a feeding speed (second feeding speed) that is slower than a feeding speed (i.e., standard feeding speed) of the standard print region NW. The feeding speed of the print region SW is, e.g., 70 mm/sec.

Next, after the feeding speed of the print regions NW and SW is set, a determination is made as to whether or not the margin region Y exists in each region of every line in the feeding direction F in the drawing data (step 201 of FIG. 7).

In a case where the margin region Y exists, a determination is made as to whether or not the margin region Y is a non-standard margin region (step 202 of FIG. 7). In a case where there is no print on the print line XL (i.e., in a case where represented by a "0") that has at least 24 dots in succession, it is determined to be the non-standard margin region. In case where there is no print on the print line XL (i.e., in a case where represented by a "1") that has less than 24 dots in succession, it is determined to be the standard margin region. For example, one dot is 0.125 mm, and thus 24 dots would correspond to a threshold value of 3 mm.

In a case where the margin region Y is a standard margin region, a standard feeding speed is set (step 203 of FIG. 7). The feeding speed of the standard margin region is, e.g., 80 mm/sec.

On the other hand, in a case where the margin region Y is the non-standard margin region, a feeding speed (third feeding speed) that is faster than the feeding speed of the standard margin region (i.e., standard feeding speed) is set (step 204 of FIG. 7).

Accordingly, the feeding speed is set for each region in the feeding direction F in the drawing data of the label PL.

Figure 8:
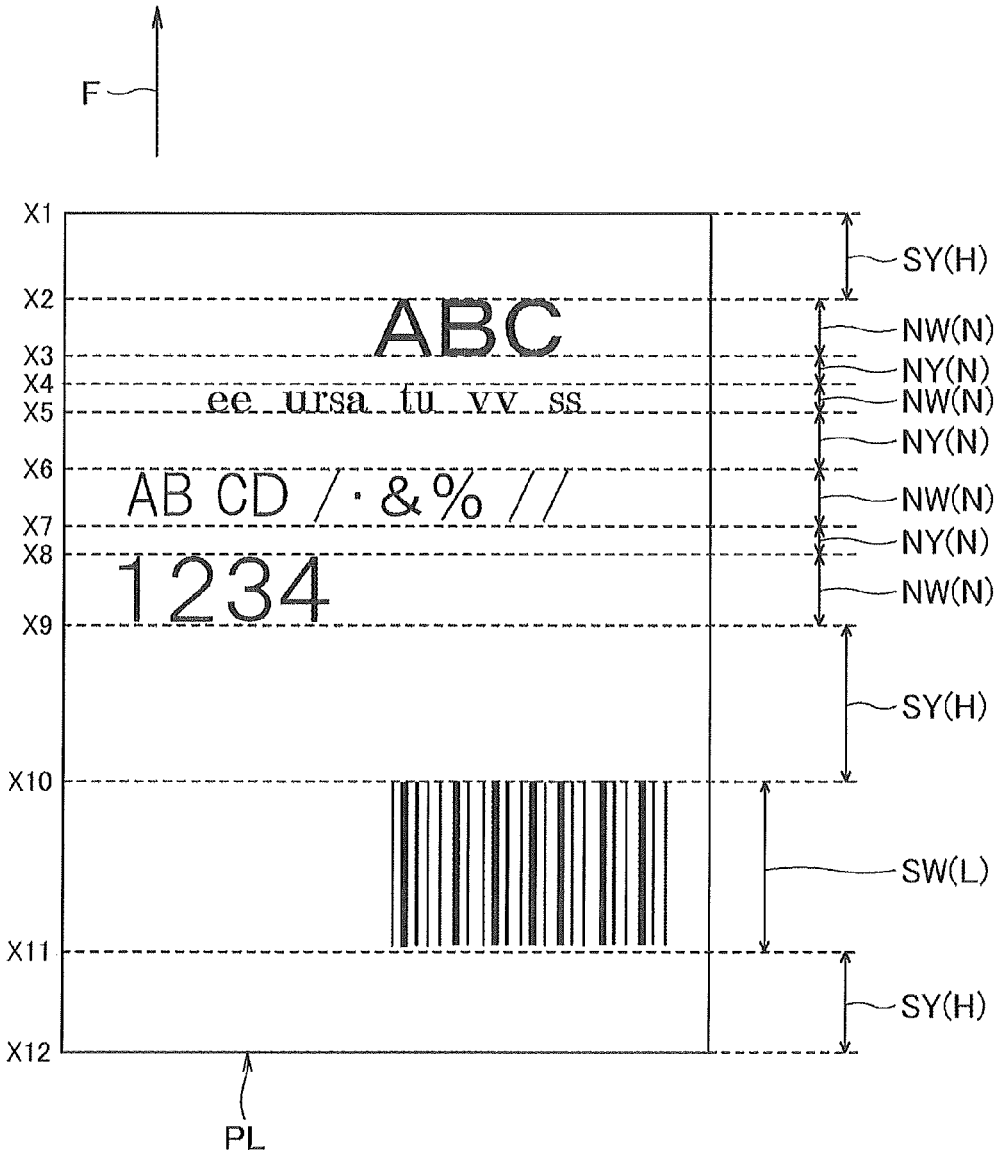
FIG. 8 shows a planar view indicating a feeding speed in each region of the single label.

FIG. 8 shows a planar view illustrating the feeding speed in each region of a single label. In FIG. 8, a numeral NY represents a standard margin region, and a numeral SY represents a non-standard margin region. Further, in FIG. 8, a numeral N represents a standard feeding speed, a numeral H represents a feeding speed that is faster than the standard feeding speed, and a numeral L represents a feeding speed that is slower than the standard feeding speed. In addition, numerals X1 to X12, on a left side of FIG. 8, represent position coordinates.

Figure 9:
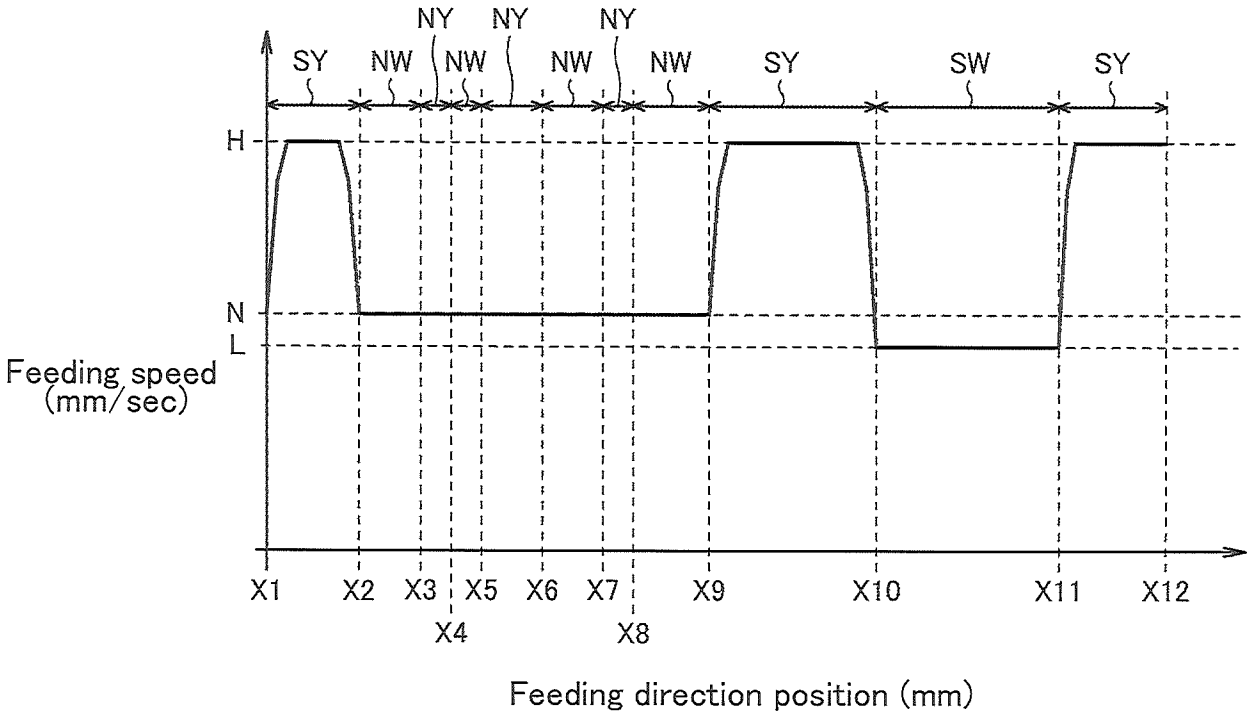
FIG. 9 shows a graph indicating a feeding speed in each region of the label of FIG. 8.

Moreover, FIG. 9 shows a graph indicating a feeding speed in each region of a label of FIG. 8. A longitudinal axis shows a feeding speed of the continuous paper P, and a horizontal axis shows position coordinates X1 to X12 for the feeding direction F of the label PL of FIG. 8

As shown in FIGS. 8 and 9, print quality of coded print information may be improved by decreasing the feeding speed of the print region SW of the coded print information. As a result, optical reading errors in the coded print information may be reduced or prevented.

Further, the print processing speed may be improved across the entire print surface of the label PL, even in a case where decreasing the feeding speed of the print region SW by increasing the feeding speed of the non-standard margin region SY faster than that of the standard margin region NY and the print regions NW and SW. Accordingly, a throughput of the print processing of the printer 1 may be improved.

A length in the feeding direction F is specified as at least 3 mm in the setting of the non-standard margin region SY because the length in the feeding direction F of the margin region Y needs at least 3 mm for setting the feeding speed H that is faster than the standard feeding speed in consideration of rise time and fall time. However, a determination of the non-standard margin region SY is not limited to at least 3 mm, and thus a threshold value thereof may be optionally modified depending on a function, an individual difference, or the like, of the motor M or printer 1.

Further, the feeding speed of the standard margin region NY may also be set to a feeding speed that is faster than the standard feeding speed N, and slower than the feeding speed of the non-standard margin region SY. However, a setting number for a feeding speed is too high in the abovementioned case, and thus control is complicated. As a result, the print processing speed across the entire surface of the label PL is decreased. In addition, in a case where the feeding speed is too high, control is sacrificed, power consumption of the rechargeable battery PS is increased, and usage time of the printer 1 is decreased.

On the other hand, in the present embodiment, the feeding speed of the standard print region NW and the standard margin region NY is set to the standard feeding speed N. Accordingly, control may be simplified and the print processing speed across the entire print surface of the label PL may be improved compared with the case that these feeding speed is set to difference speed from each other, Further, the power consumption of the rechargeable battery PS may be decreased and the lifespan of the rechargeable battery PS may be improved. As a result, the usage time of the printer 1 may be increased.

Second Embodiment

Figure 10:
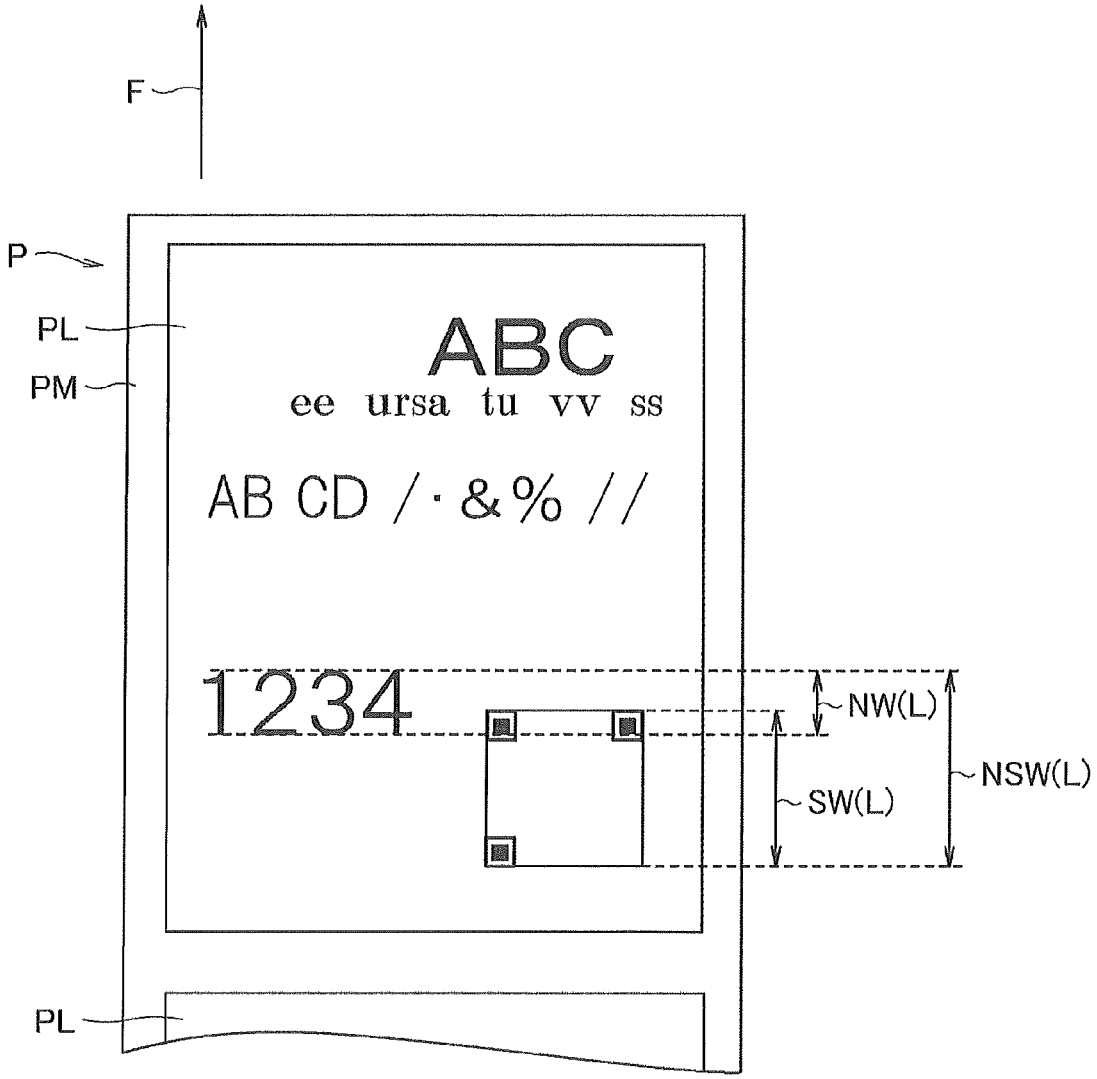
FIG. 10 shows a main part planar view of the continuous paper indicating the other example of the print information printed on the single label.
Figure 11:
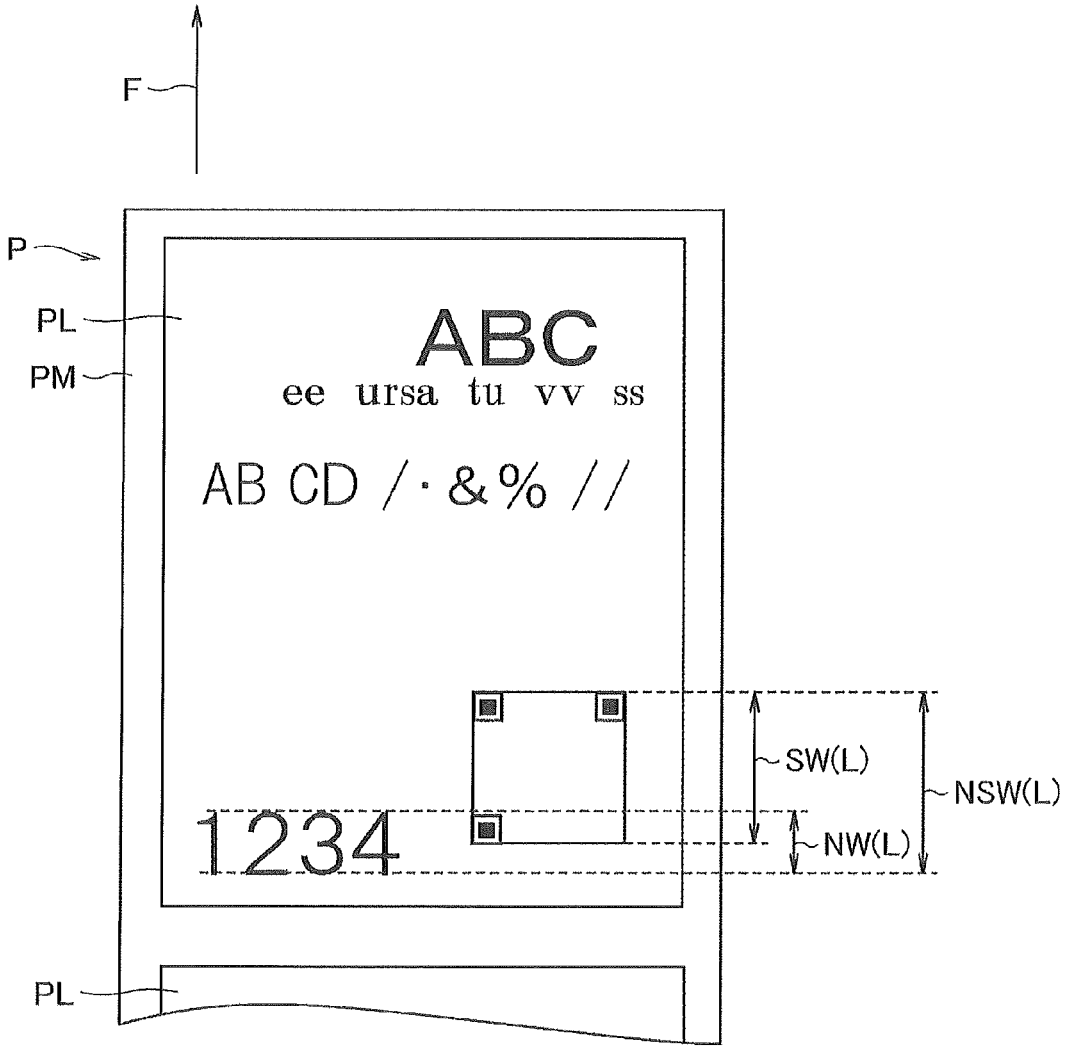
FIG. 11 shows a main part planar view of the continuous paper indicating the other example of the print information printed on the single label.

FIGS. 10 and 11 show planar views of a main part of the continuous paper illustrating the other examples of print information printed on the single label. The feeding speed L is illustrated in parentheses in FIGS. 10 and 11.

In the present embodiment, as shown in FIGS. 10 and 11, the coded print information is arranged with the standard print information in the width direction of the mount PM in parallel. Furthermore, the standard print information includes a partially protruding portion that partially extends from the print region SW of the coded print information that is arranged with the standard print information on an front side (feeding direction F of FIG. 10) or back side (direction opposite to feeding direction F of FIG. 11) in the lengthwise direction of the mount PM. A two-dimensional code is exemplified as the coded print information.

In such a case, the feeding speed of the print region NW of the standard print information that includes the partially protruding portion is set to a feeding speed of the print region SW of the coded print information, i.e., set to the feeding speed L that is slower than the standard feeding speed N.

In FIG. 10, a print region NSW, from a front end of the standard print information to the back end of the coded print information, is set to the feeding speed L that is slower than the standard feeding speed N. Further, in FIG. 11, the print region NSW, from a front end of the coded print information to the back end of the standard print information, is set to the feeding speed L that is slower than the standard feeding speed N.

In a case where changing a feeding speed at a portion where the coded print information overlaps and where the coded print information does not overlap in the print region of the standard print information, print is incomplete and faint at a portion where the feeding speed has been changed, and thus the print quality of the standard print information decreases.

On the other hand, in the present embodiment, in a case where part of the print region NW of the standard print information overlaps with the print region SW of the coded print information, the print quality of the standard print information may be ensured by setting the feeding speed of the print region NW of the standard print information to the feeding speed of the print region SW of the coded print information.

In a case where it is determined that a print line on which a code is printed and a print line on which a standard character is printed are the same print line, a controller may determine to change a print speed of a print line of a standard character to the feeding speed L that is slower than the standard feeding speed N as priority.

Configurations other than that described above are considered to be similar to that of the first embodiment. Specifically, a feeding speed of the print region NW of the standard print information for a condition other than that described above is set to the standard feeding speed N similar to that of the first embodiment.

Although a variety of examples and other information have been used to explain various aspects described by the present inventors within the scope of the appended claims, no limitation of the claims should be implied based on particular features or arrangements in such examples, as one of ordinary skill would be able to use these examples to derive a wide variety of implementations. Furthermore, and although some subject matter may have been described in language specific to examples of structural features and/or method steps, it should be understood that the subject matter defined in the appended claims is not necessarily limited to those described features or acts. Therefore, the described features and steps are disclosed as examples of components and methods that are deemed to be within the scope of the following claims.

For example, in a case where the embodiments describe using a light reflection sensor as a paper position detection sensor, the paper position detection sensor is not limited in such a manner, e.g., a light transmission sensor may be employed. In such a case, the light emitter and the light reflector are configured to sandwich the continuous paper. In addition, a part that is attached to the label does not transmit light and a part that is not attached to the label does transmit light. Based on the above light transmission properties, a position of the label is detected by detecting a spaced interval part where the label is not attached.

In addition, in a case where the embodiments describe using the continuous paper that has the plurality of labels temporarily attached to the mount as the print medium, the print medium is not limited, e.g., a continuous label that includes an adhesive surface on one surface thereof (mountless label), a continuous sheet that lacks an adhesive surface (continuous sheet), or a film other than the paper type that is printable by the thermal head may be employed as the print medium. The mountless label, the continuous sheet, or the film may include a position detection mark. Further, in a case where feeding a mountless label that has an adhesive agent exposed, a feeding pathway may be coated with a non-adhesive material and a roller containing silicone may be employed. In addition, the application of print is not limited to the continuous paper, e.g., print may also be applied to a film or single paper.

Further, in a case where the embodiments describe that a black bar of a barcode is employed in the parallel code extending along a feeding direction, the black bar of the barcode is not limited, e.g., the black bar of the barcode may be employed in the serial barcode extending in the width direction of the mount.

Moreover, in a case where the embodiments describe employment of a heat-sensitive-type thermal printer that uses heat-sensitive paper, the thermal printer is not limited, e.g., a thermal transfer-type thermal printer that uses an ink ribbon may also be employed as the thermal printer.

In addition, in a case where the embodiments describe feeding the coded print information SW at a feeding speed of 70 m/sec, feeding the standard print information NW at a feeding speed of 80 m/sec, and feeding the non-standard margin region SY at a feeding speed of 140 m/sec, a value of each feeding speed is not limited to the above value. It is enough that a relational formula between a feeding speed of the coded print information SW, the standard print information NW, and the non-standard margin region SY is defined as SW<NW<SY.

INDUSTRIAL APPLICABILITY

In the above description, in a case where an aspect of a present disclosure describes the employment of a portable printer, such employment is not limited thereto, e.g., another thermal printer such as a desktop thermal printer and the other type of thermal printer may also be employed.

DESCRIPTION OF REFERENCE NUMERALS

1 Printer;
2 Casing;
2*a* Housing;
2*b* Opening and closing cover;
3 Continuous paper container;
4 Ejection port;
10 Position detection sensor;
11 Thermal head;
12 Platen roller;
20 Support member;
21 Spring;
22 Press-button;
23 Battery container;
24 Cutter;
25 Inputter;
26 Display;
27 Power switch;
28 Belt-hanging part;
30 CPU;
31 ROM;
32 RAM;
33 Feed control circuit;
34 Print control circuit;
35 Label detection circuit;
36 Interface;
37 Display control circuit;
38 Communication interface;
39 EEPROM;
40 Bus line;
P Continuous paper;
PM Mount;
PL Label;
PA Position detection mark;
MC Controller;
PS Rechargeable battery;
RC Wireless communicator;
M Motor;
G1 Gear;
G2 Connection gear

The invention claimed is:

1. A printer comprising:

a feeder configured to feed a print medium towards a feeding direction;

a thermal head configured to print print information on the print medium fed by the feeder on each print line orthogonal to the feeding direction, the print information including first print information and second print information, the first print information being coded, the second print information being not coded; and a controller configured to control a feeding speed of the feeder, wherein the controller sets a second feeding speed to a first print line including the first print information, the second feeding speed slower than a first feeding speed, the controller sets the first feeding speed to a second print line including the second print information, the second print line not including the first print information, the controller sets the second feeding speed to a third print line including a protruding portion of the second print information included in the first print line, the protruding portion protruding from the first print line in the feeding direction, and the controller sets the first feeding speed to a second margin region, the length of the second margin region in the feeding direction being equal to or less than a threshold.

2. The printer of claim 1, wherein the controller sets a third feeding speed to a first margin region, the length of the first margin region in the feeding direction being more than the threshold, the third feeding speed faster than the first feeding speed.

3. The printer of claim 2, wherein the first print information is a serial barcode or a two-dimensional bar code.

4. The printer of claim 2, wherein the first print information includes at least one of information indicating a print starting position, information indicating a print finishing position, information indicating a length in the feeding direction, or information indicating a length in a width direction orthogonal to the feeding direction.

5. The printer of claim 2, wherein the controller sets a print line including a both of the first print information and the second print information to the second feeding speed.

6. The printer of claim 1, wherein the first print information is a serial barcode or a two-dimensional bar code.

7. The printer of claim 6, wherein the first print information includes at least one of information indicating a print starting position, information indicating a print finishing position, information indicating a length in the feeding direction, or information indicating a length in a width direction orthogonal to the feeding direction.

8. The printer of claim 6, wherein the controller sets a print line including a both of the first print information and the second print information to the second feeding speed.

9. The printer of claim 1, wherein the first print information includes at least one of information indicating a print starting position, information indicating a print finishing position, information indicating a length in the feeding direction, or information indicating a length in a width direction orthogonal to the feeding direction.

10. The printer of claim 1, wherein the controller sets a print line including a both of the first print information and the second print information to the second feeding speed.

11. A method of setting a feeding speed of feeding print medium in a printer comprising a feeder configured to feed the print medium towards a feeding direction, a thermal head configured to print print information on the print medium fed by the feeder on each print line orthogonal to the feeding direction, the print information including first print information and second print information, the first print information being coded, the second print information being not coded, and a controller configured to control a feeding speed of the feeder, the method comprising the controller-implemented steps of:

setting a second feeding speed to a first print line including the first print information, the second feeding speed slower than a first feeding speed, setting the first feeding speed to a second print line including the second print information, the second print line not including the first print information, setting the second feeding speed to a third print line including a protruding portion of the second print information included in the first print line, the protruding portion protruding from the first print line in the feeding direction, and setting the first feeding speed to a second margin region, the length of the second margin region in the feeding direction being equal to or less than a threshold.

12. The method of claim 11, further comprising the controller setting a third feeding speed to a first margin region, the length of the first margin region in the feeding direction more than the threshold, the third feeding speed being faster than the first feeding speed.

13. The method of claim 12, wherein the first print information is a serial barcode or a two-dimensional bar code.

14. The printer of claim 12, wherein the first print information includes at least one of information indicating a print starting position, information indicating a print finishing position, information indicating a length in the feeding direction, or information indicating a length in a width direction orthogonal to the feeding direction.

15. The method of claim 12, wherein in setting the feeding speed to the second print line, the feeding speed of a print line including a both of the first print information and the second print information is set to the second feeding speed.

16. The method of claim 11, wherein the first print information is a serial barcode or a two-dimensional bar code.

17. The method of claim 16, wherein the first print information includes at least one of information indicating a print starting position, information indicating a print finishing position, information indicating a length in the feeding direction, or information indicating a length in a width direction orthogonal to the feeding direction.

18. The method of claim 16, wherein in setting the feeding speed to the second print line, the feeding speed of a print line including a both of the first print information and the second print information is set to the second feeding speed.

19. The method of claim 11, wherein the first print information includes at least one of information indicating a print starting position, information indicating a print finishing position, information indicating a length in the feeding direction, or information indicating a length in a width direction orthogonal to the feeding direction.

20. The method of claim 11, wherein in setting the feeding speed to the second print line, the feeding speed of a print line including a both of the first print information and the second print information is set to the second feeding speed.

* * * * *